United States Patent [19]

Marcio'

[11] 4,085,900

[45] Apr. 25, 1978

[54] BOBBIN-CHANGING DEVICE WITH AUTOMATIC MEANS FOR SEVERING THE THREAD OR STRIP

[75] Inventor: Pietro Marcio', Arese (Milan), Italy

[73] Assignee: Sant' Andrea Novara Officine Meccaniche e Fonderie S.p.A., Novara, Italy

[21] Appl. No.: 727,565

[22] Filed: Sep. 28, 1976

[30] Foreign Application Priority Data

Oct. 3, 1975 Italy ..... 69458 A/75

[51] Int. Cl.[2] ..... B65H 54/46

[52] U.S. Cl. ..... 242/18 DD; 242/54.4

[58] Field of Search ..... 242/18 DD, 18 R, 18 A, 242/54.4

[56] References Cited

U.S. PATENT DOCUMENTS

| | | | |
|---|---|---|---|
| 1,517,279 | 12/1924 | Colman | 242/18 DD |
| 2,131,148 | 9/1938 | Siegenthaler | 242/18 R |
| 3,117,738 | 1/1965 | Raasch et al. | 242/18 R |
| 3,559,902 | 2/1971 | Brock | 242/18 A |
| 3,758,042 | 9/1973 | Sear | 242/18 A |

FOREIGN PATENT DOCUMENTS

| | | | |
|---|---|---|---|
| 733,605 | 10/1932 | France | 242/18 A |

*Primary Examiner*—Harvey C. Hornsby
*Assistant Examiner*—John M. Jillions
*Attorney, Agent, or Firm*—Sughrue, Rothwell, Mion, Zinn and Macpeak

[57] ABSTRACT

A bobbin-changing device for a textile winding machine in which an elongate thread or strip of textile fibres such as spun yarn, sliver or roving is wound on successive bobbins, the device being for replacing a fully wound bobbin with an empty bobbin and including means for allowing the fully wound bobbin to drop down from its winding position and a frictional member which is engaged by the periphery of the fully wound bobbin at a position roughly diametrically opposed to the position at which the thread or strip reaches the periphery of the fully wound bobbin as the bobbin drops down from its winding position, for accelerating in the wind-on direction the position at which the thread or strip reaches the periphery of the fully wound bobbin and thereby breaking the thread or strip.

6 Claims, 3 Drawing Figures

BOBBIN-CHANGING DEVICE WITH AUTOMATIC MEANS FOR SEVERING THE THREAD OR STRIP

BACKGROUND OF THE INVENTION

The present invention relates to a bobbin-changing device for a textile winding machine in which an elongate filamentary member, more specifically a thread or strip, composed of textile fibres is wound on successive bobbins, the device being for replacing a fully wound bobbin with an empty bobbin, and including means for allowing the fully wound bobbin to drop down from its winding position and automatic means for severing the thread or strip near the periphery of the fully wound bobbin so that the new leading end of the thread or strip can be passed to an empty bobbin.

The invention is particularly, but not exclusively, applicable to the winding machine (normally termed a winding frame) of a high draft or attenuation drafting frame, but in general, the thread can be any spun yarn of preferably discontinuous textile fibres, or the strip can be a sliver or a roving. The rotary member on which the thread or strip is wound is termed herein a bobbin, but the term bobbin is used to include any suitable rotary member. In the art, the fully wound bobbin may be referred to as a reel.

Normal practice for severing the thread or strip is to cut the thread or strip, and British Patent Specification No. 1,308,842 discloses one prior cutting means.

A disadvantage of the use of cutting means is that the cutting means must be resharpened from time to time, and it is also difficult to insert the cutting means between the bobbin and the drive roll (the member which engages the periphery of the bobbin and causes it to rotate) in such a way that the thread or strip is cut close to the bobbin so as to leave a reasonably long leading end for attachment to the empty bobbin.

However, automatic means have been proposed for severing or breaking the thread or strip solely by applying excessive tension thereto, i.e. without the use of any cutting means for severing the thread or strip. The elimination of the cutting means avoids any necessity for resharpening, and it is found that the thread or strip can be broken at or very close to the periphery of the fully wound bobbin, leaving a new end which is as long as possible. No extra member need be brought into contact with the thread or strip, the extra friction where the thread or strip passes over the drive roll (which is used in most textile winding machines) ensuring that the thread or strip is broken between the drive roll and the periphery of the fully wound bobbin.

In one such proposal, the fully wound bobbin is dropped down so quickly that the position at which the thread or strip reaches the periphery of the fully wound bobbin moves faster than the delivery of the thread or strip. However, the fully wound bobbin is a heavy object, and the device must be especially strong subsequently to stop the falling bobbin, or a special decelerating arrangement must be incorporated, both of which alternatives make the device more expensive.

In another proposal, the rotation of the bobbin is speeded up for a short period, thereby accelerating in the winding on direction the position at which the thread or strip reaches the periphery of the fully wound bobbin. This proposal involves the incorporation of a special transmission, for example a change speed gear box, in the drive to drive the roll, making the arrangement significantly more expensive.

It is an object of this invention to simplify the automatic breaking means and to avoid increasing the kinetic energy of the fully wound bobbin over that attained during normal drop-down after winding.

THE INVENTION

According to the present invention, the automatic severing or breaking means is a frictional member which is engaged by the periphery of the fully wound bobbin at a position roughly diametrically opposed to the position at which the thread or strip reaches the periphery of the fully wound bobbin as the bobbin drops down from its winding position.

The frictional member can be a simple mechanical device whose incorporation does not greatly increase the cost of the textile winding machine and which does not require much maintenance. The delivery of thread or strip is not interrupted but the kinetic energy of the fully wound bobbin is not increased over that it attains during normal drop-down after winding.

BRIEF DESCRIPTION OF THE DRAWING

The invention will be further described, by way of example, with reference to the accompanying drawing, of which

DETAILED DESCRIPTION OF ONE EMBODIMENT OF THE INVENTION

Figure 1:
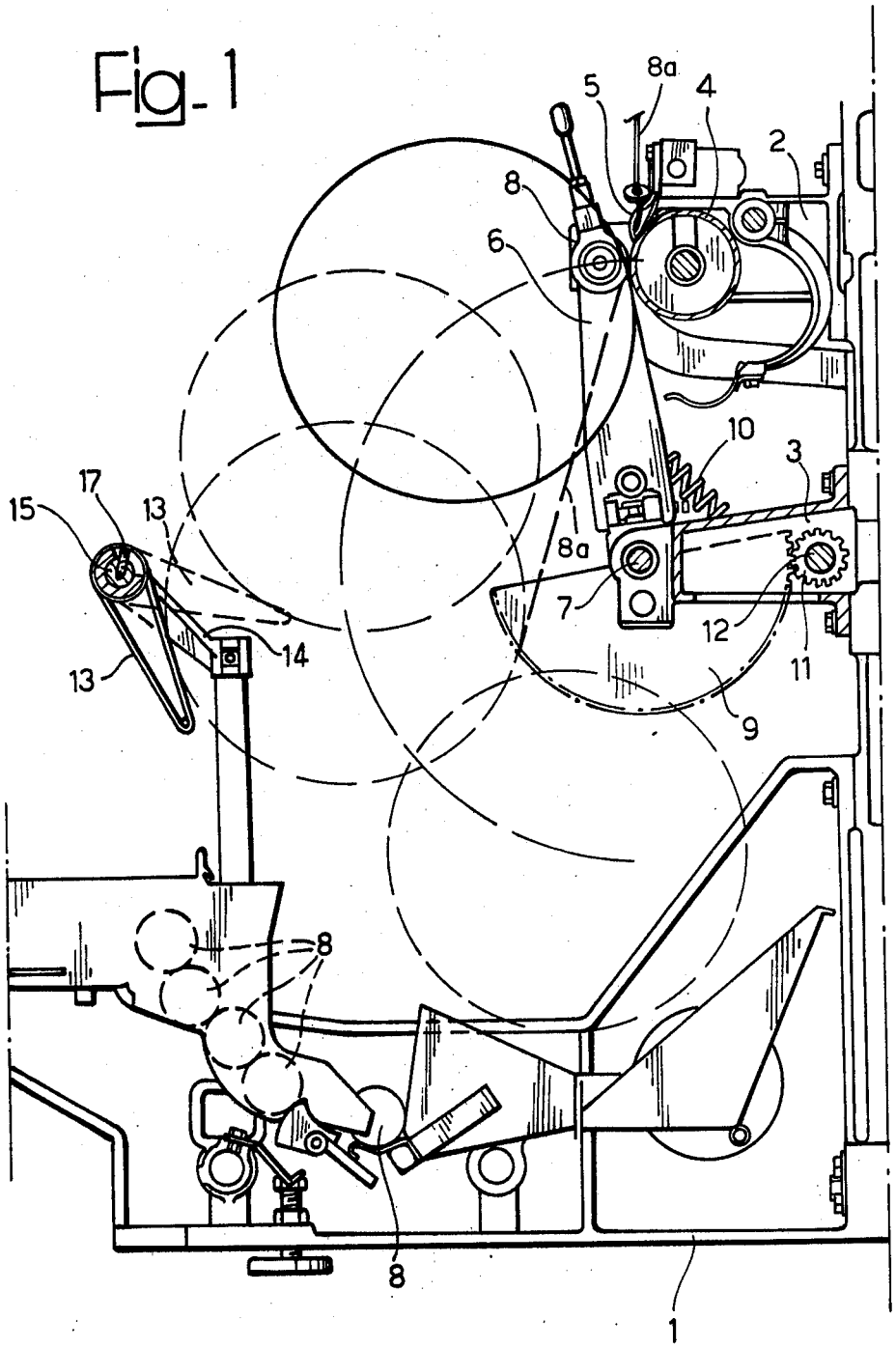
FIG. 1 is a vertical section through a bobbin-changing device in accordance with the invention, part of the section being taken along the line I—I in FIG. 3.
Figure 2:
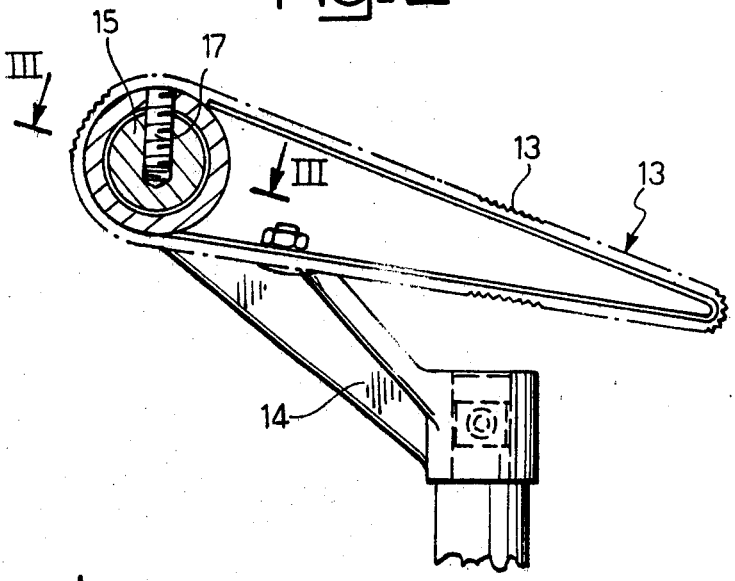
FIG. 2 is a detail of FIG. 1, on a larger scale.
Figure 3:
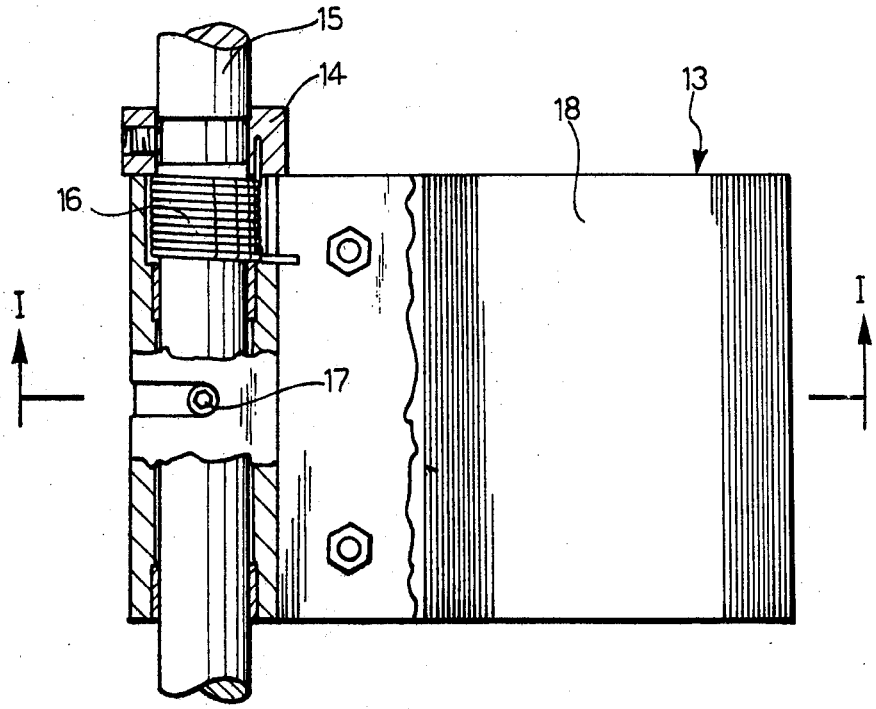
FIG. 3 is a view of the part shown in FIG. 2, partially in section along the line III—III.

In its basic construction, the bobbin-changing device can be similar to that described in British Patent Specification Nos. 1,308,842 and 1,320,978 whose disclosures are incorporated herein by reference, and will not be described in detail. The device is incorporated in a winding machine, which comprises a support structure 1 carrying two brackets 2, 3, the upper bracket 2 mounting a drive roll 4 and guide means in the form of a traverse 5, the lower bracket 3 mounting pivoted arms 6 which can swing about the axis of a pivot shaft 7 and carry a bobbin 8.

As a summary of the basic construction, the pivoted arms 6 are sprung upwards and hold the periphery of the bobbin 8 or of the reel being formed on the bobbin 8 against the drive roll 4, and during winding the drive roll 4 is driven to rotate the bobbin 8 whilst the traverse 5 is moved to-and-fro from end to end of the bobbin 8, to lay the thread or strip 8*a* in a proper pattern upon the bobbin 8. At the end of winding, the drive roll 4 stops, stopping the bobbin 8, a mechanism is operated to swing the pivoted arms 6 down and, towards the end of their swing-down movement, to release the fully wound bobbin 8 and pick up an empty bobbin 8.

As described in detail in British Patent Specification No. 1,320,978, the mechanism includes spaced, toothed sectors 9 which are freely rotatable upon the shaft 7 but are connected to the arms 6 by respective tension springs 10 which, in the winding position (the position of the sectors 9 shown in FIG. 1), spring the arms 6 upwards. The sectors 9 mesh with pinions 11 fixed to a cross-shaft 12 in turn connected to a driving unit (not shown). At the end of winding, the driving unit is operated to swing the sectors anti-clockwise (as seen in FIG. 1) and thus swing down the arms 6. When the arms 6 descend the bobbin 8 begins to rotate slowly in in the counter-clockwise direction (as seen in FIG. 1) because the thread or strip 8a does not advance significantly and thus is drawn off the bobbin 8 to a certain extent.

In accordance with the invention, automatic means in the form of a frictional member 13 is provided in the drop-down path of the bobbin 8 for engaging the periphery of the fully wound bobbin 8 at a position roughly diametrically opposed to the position at which the thread or strip reaches the periphery of the fully wound bobbin 8, the frictional member 13 being pivotally mounted between two spaced pedestals 14 for movement about the axis of a fixed spindle 15 which is parallel to the shaft 7 and parallel to the axis of the bobbin 8. The frictional member 13 is on the opposite side of the bobbin 8 to the axis of the shaft 7 and spaced from the latter axis by a distance less than the sum of the radius of the fully wound bobbin and the distance apart of the bobbin axis and the axis of the shaft 7. The frictional member 13 is spring biased by a spring 16 into a roughly horizontal position indicated in dash-dot lines in FIG. 1 (which position is determined by an abutment peg 17), but can pivot down against this spring biasing. The frictional member 13 is provided with a covering 18 of a suitable corrugated elastomeric material such as rubber, with the corrugations running parallel to the axis of the bobbin 8.

When the pivoted arms 6 swing down at the end of winding, the frictional member 13 is engaged by the periphery of the fully wound bobbin 8, rapidly accelerating the bobbin 8 in the winding on direction. This rapid acceleration applies excessive tension to the thread or strip and breaks the thread or strip. The acceleration will depend upon the speed of descent of the pivoted arm 6 and must be sufficiently rapid to break the thread or strip 8a. This speed of descent is not critical, and in practice, it is found that the normal speed of descent which is required for bobbin changing without excessive loss of winding time, causes reliable breakage with a rubber-covered frictional member 13 of the size shown in the drawings. As the thread or strip at the moment of breakage passes round a portion of the periphery of the drive roll 4 as viewed in FIG. 1, the frictional contact between the thread or strip and the drive roll 4 ensures that the thread or strip is broken between the drive roll 4 and the periphery of the fully wound bobbin 8. In addition, due to the inertia effect and the small but significant natural extendability of the thread or strip, the maximum tension is applied to the thread or strip at the periphery of the fully wound bobbin 8, and the thread or strip will break at or very near the periphery of the fully wound bobbin 8. The leading end of the thread or strip can be passed to and taken up by an empty bobbin in any suitable manner, for example, as described in British Patent Specification No. 1,308,842.

The pivotal mounting of the frictional member 13 enables the same arrangement to be used for fully wound bobbins 8 of various different diameters. The frictional member 13 is, as shown, preferably in the form of a plate which extends for the whole length of the bobbin 8 so as to distribute the force it applies to the bobbin 8 over as large an area as possible and avoid damaging the thread or strip on the bobbin 8.

What I claim is:

1. A textile winding machine for winding an elongate filamentary member composed of textile fibres, the machine comprising:

means for rotatably supporting a rotary winding member for receiving the filamentary member;

means for rotating the rotary winding member in a wind-on direction and while in a winding zone, to wind the filamentary member thereon;

guide means for guiding the filamentary member to a part of the periphery of the rotary winding member which descends during rotation of the rotary winding member in the wind-on direction;

means for allowing the fully wound rotary winding member to descend from its winding zone and follow a descent path; and a frictional member in the descent path and on the side of the axis of the rotary winding member towards which the bottom part of the rotary winding member rotates in the wind-on direction, whereby the frictional member is engaged by the periphery of the fully wound rotary winding member to accelerate the winding member in the wind-on direction thereby breaking the filamentary member.

2. The textile winding machine of claim 1, and comprising means pivotally mounting the frictional member for movement about an axis which is parallel to the axis of the rotary winding member, and spring means biasing the frictional member into a roughly horizontal position.

3. The textile winding machine of claim 1, wherein the frictional member is provided with a covering of corrugated elastomeric material with the corrugations running parallel to the axis of the rotary winding member.

4. The textile winding machine of claim 1, wherein the frictional member comprises plate means which extend for the whole length of the rotary winding member.

5. A textile winding machine for winding an elongate filamentary member composed of textile fibres, the machine comprising:

two support arms for rotatably supporting a rotary winding member in a winding zone for receiving the filamentary member;

means pivotally mounting the support arms for pivotal movement about a pivot axis spaced from and parallel to the axis of the rotary winding member;

means for allowing the support arms to swing down, whereby the rotary winding member descends from the winding zone and follows a descent path;

means for rotating the rotary winding member in a wind-on direction to wind the filamentary member thereon;

guide means for guiding the filamentary member to that part of the periphery of the rotary winding member which is nearest the pivot axis of the support arms; and a frictional member in the descent path but on the opposite side of the axis of the bobbin to the bobbin to the pivot axis of the support arms, whereby the frictional member is adapted to be engaged by the periphery of the fully wound rotary winding member to accelerate the winding member in the wind-on direction thereby breaking the filamentary member.

6. The textile winding machine of claim 5, and comprising means pivotally mounting the frictional member for movement about an axis which is parallel to the axis of the rotary winding member, and spring means biasing the frictional member into a roughly horizontal position.

* * * * *